US012601081B1

(12) United States Patent
Salmon et al.

(10) Patent No.: US 12,601,081 B1
(45) Date of Patent: Apr. 14, 2026

(54) DEVICES, SYSTEMS, AND METHODS FOR TREATMENT OF TUBULARS

(71) Applicant: Oceanit Laboratories, Inc., Honolulu, HI (US)

(72) Inventors: Colby Salmon, Kailua, HI (US); Ganesh Arumugam, Honolulu, HI (US); Ian Wasnich, Honolulu, HI (US); Vinod Veedu, Houston, TX (US); Glen Nakafuji, Honolulu, HI (US)

(73) Assignee: Oceanit Laboratories, Inc., Honolulu, HI (US)

( * ) Notice: Subject to any disclaimer, the term of this patent is extended or adjusted under 35 U.S.C. 154(b) by 599 days.

(21) Appl. No.: 18/115,692

(22) Filed: Feb. 28, 2023

Related U.S. Application Data

(60) Provisional application No. 63/314,851, filed on Feb. 28, 2022.

(51) Int. Cl.
*C25D 7/04* (2006.01)
*C25D 15/00* (2006.01)
*F41A 21/02* (2006.01)

(52) U.S. Cl.
CPC ..... *C25D 15/00* (2013.01); *C25D 7/04* (2013.01); *F41A 21/02* (2013.01)

(58) Field of Classification Search
CPC ..... C25D 7/04; C23C 14/046
See application file for complete search history.

(56) References Cited

U.S. PATENT DOCUMENTS

| | | | | |
|---|---|---|---|---|
| 1,982,009 | A * | 11/1934 | Mckinney | C25D 7/04 204/280 |
| 4,125,447 | A * | 11/1978 | Bachert | C25D 7/04 205/132 |
| 9,890,464 | B2 | 2/2018 | Arumugam et al. | |
| 10,190,229 | B1 | 1/2019 | Nakafuji et al. | |
| 10,240,244 | B2 | 3/2019 | Arumugam et al. | |
| 2017/0130357 | A1* | 5/2017 | Adkisson | C25D 13/14 |

* cited by examiner

*Primary Examiner* — Luan V Van
(74) *Attorney, Agent, or Firm* — Fresh IP PLC; Clifford D. Hyra; Aubrey Y. Chen

(57) ABSTRACT

Disclosed herein are devices, methods, and systems for applying a coating and/or a plating to a surface, including metal surfaces on tubulars or gun barrels. In at least one embodiment, a device includes a rod and an applicator that is rotatable around the rod. The applicator includes a base on which are fixedly attached one or more arms. At one end of the arms is attached one or more applicator pads, which contain the coating and/or plating to be attached to a surface. In a further embodiment, a novel ablative coating includes an electroplated nanostructured porous metal layer combined with embedded nanoparticles. The porous metal layer may include zinc (Zn) and nickel (Ni), and/or alloys thereof. The embedded nanoparticles may include titanium dioxide ($TiO_2$) and hexagonal Boron Nitride (hBN), which are anti-corrosion, friction-reducing, and/or thermally insulating.

18 Claims, 7 Drawing Sheets

450

402

DEVICES, SYSTEMS, AND METHODS FOR TREATMENT OF TUBULARS

CROSS-REFERENCE TO RELATED APPLICATION

This application claims priority to U.S. Provisional Application No. 63/314,851, filed Feb. 28, 2022, which is hereby incorporated by reference in its entirety.

FIELD

The disclosure relates generally to devices, systems, and methods for treatment of tubulars, including, for instance, firearm and cannon barrels, to protect against erosion, heat, friction, and/or corrosion. In particular, the disclosure relates to a rotating applicator to coat the interior and/or exterior of a tubular with metal plating.

BACKGROUND

Metal tubulars are used in a variety of industries and applications, such as the energy industry (including, for instance, mining and oil production), military and defense applications, and commercial and industrial applications. Such tubulars often encounter, or are used in, environments that produce erosion, corrosion, and/or general wear of the metal tubular walls. For example, protecting and reducing barrel erosion in firearms and large caliber gun weapons is a priority in specific defense and commercial applications.

Current methods for protecting metal tubular walls against erosion, corrosion, and general wear involve electroplating the wall with an electrical circuit and a metal plating solution. However, such methods use hazardous solutions that must be applied with personal protective equipment (PPE) and must be disposed of as hazardous waste. As a result, these methods are both labor- and cost-intensive.

For example, hard chromium plating (e.g., electroplated hexavalent chromium) is a currently-established standard for gun barrel protection, particularly for large caliber gun barrels. Chrome has a significantly greater melting point than typical gun barrel steel, along with a greater Young's modulus at extremely elevated temperatures, greater fracture toughness, and enhanced hardness. However, the electroplating process, whereby surfaces and/or parts to be coated, are submerged in acidic $Cr^{6+}$ solutions, has the drawbacks of (1) non-uniform coating, and (2) requiring post-process thermal baking to remove hydrogen ions produced and trapped within the chromium during plating. The overall volume reduction due to the liberation of hydrogen forms micro-cracks within the coating, which cannot freely contract and relieve these stresses. These cracks allow for gases generated during firing to penetrate down to the steel surface, to form additional oxides, and to eventually weaken the bond between the chrome plating and the surface such that the plating can be removed through the induced shear stresses caused by the action of the propellant gas within the gun barrel alone. Once coating holidays form and the surface becomes exposed, the thermal mismatch between the two metals (e.g., chromium and steel) accelerates the process, increasing surface roughness and friction within the barrel. Such coating holidays are defects and/or anomalies in the coating and/or coated surface (e.g., non-coated areas of the surface, improperly coated areas, holes, inclusions, etc.). Thus, even relatively small defects and cracks inherent in the plating process can lead to premature coating failure.

Given the foregoing, there exists a significant need for devices, systems, and methods that can provide adequate protection against erosion and/or general wear (including, for instance, corrosion, resistance against high-pressure and/or high-temperature environments, resistance against friction, and the like) for metal tubulars, and specifically, metal tubular walls. In particular, there is a need for devices, systems, and methods to apply coatings that provide the aforementioned protection in an easy and cost-effective manner.

SUMMARY

It is to be understood that both the following summary and the detailed description are exemplary and explanatory and are intended to provide further explanation of the invention as claimed. Neither the summary nor the description that follows is intended to define or limit the scope of the invention to the particular features mentioned in the summary or in the description.

In certain embodiments, the disclosed embodiments may include one or more of the features described herein.

Embodiments of the present disclosure are directed towards devices, systems, and/or methods for applying a coating, which comprises metal plating, to the interior and/or the exterior of a tubular. In particular, embodiments relate to a device comprising a rotating applicator on a rod assembly, where the device is usable to apply metal plating on a metal tubular wall (e.g., the interior and/or exterior walls of a firearm or gun barrel). In some embodiments, a low power circuit is connected to both the tubular to be coated and the applicator, thereby supplying an electrical current that drives the plating process. In additional embodiments, the applicator may also comprise applicator pads that contain and/or apply one or more coatings to the metal surface or wall to be coated and/or plated. Such applicator pads may, in some embodiments, traverse the metal surface or wall to be plated in order to apply the one or more coatings.

One or more coatings are therefore also described herein that can be applied to a variety of surfaces, including, for instance, metal and/or metal alloy surfaces. These one or more coatings may provide increased resistance to the coated surface against environments that contain high temperatures, high pressures, a high degree of erosion, a high degree of corrosion or corrosive mixtures, a high degree of friction (e.g., projectile friction), hot gases, and the like.

Embodiments of the present disclosure utilize the Solid Electrolyte/Electrode Assembly For Electrochemical Surface Finishing Applications (SOAP) technology and other related deposition materials, methods, and systems as described in U.S. Pat. Nos. 9,890,464, 10,240,244, and 10,190,229 (the "SOAP Patents"), each of which is incorporated herein by reference.

Accordingly, embodiments of the disclosure do not require toxic solutions, which are used in currently available, state-of-the-art methods such as conventional electroplating. Moreover, such embodiments do not generate hazardous waste or require personal protective equipment (PPE) to apply.

These and further and other objects and features of the invention are apparent in the disclosure, which includes the above and ongoing written specification, as well as the drawings.

BRIEF DESCRIPTION OF THE DRAWINGS

The accompanying drawings, which are incorporated herein and form a part of the specification, illustrate exemplary embodiments and, together with the description, further serve to enable a person skilled in the pertinent art to make and use these embodiments and others that will be apparent to those skilled in the art. The invention will be more particularly described in conjunction with the following drawings wherein.

DETAILED DESCRIPTION

Figure 1:
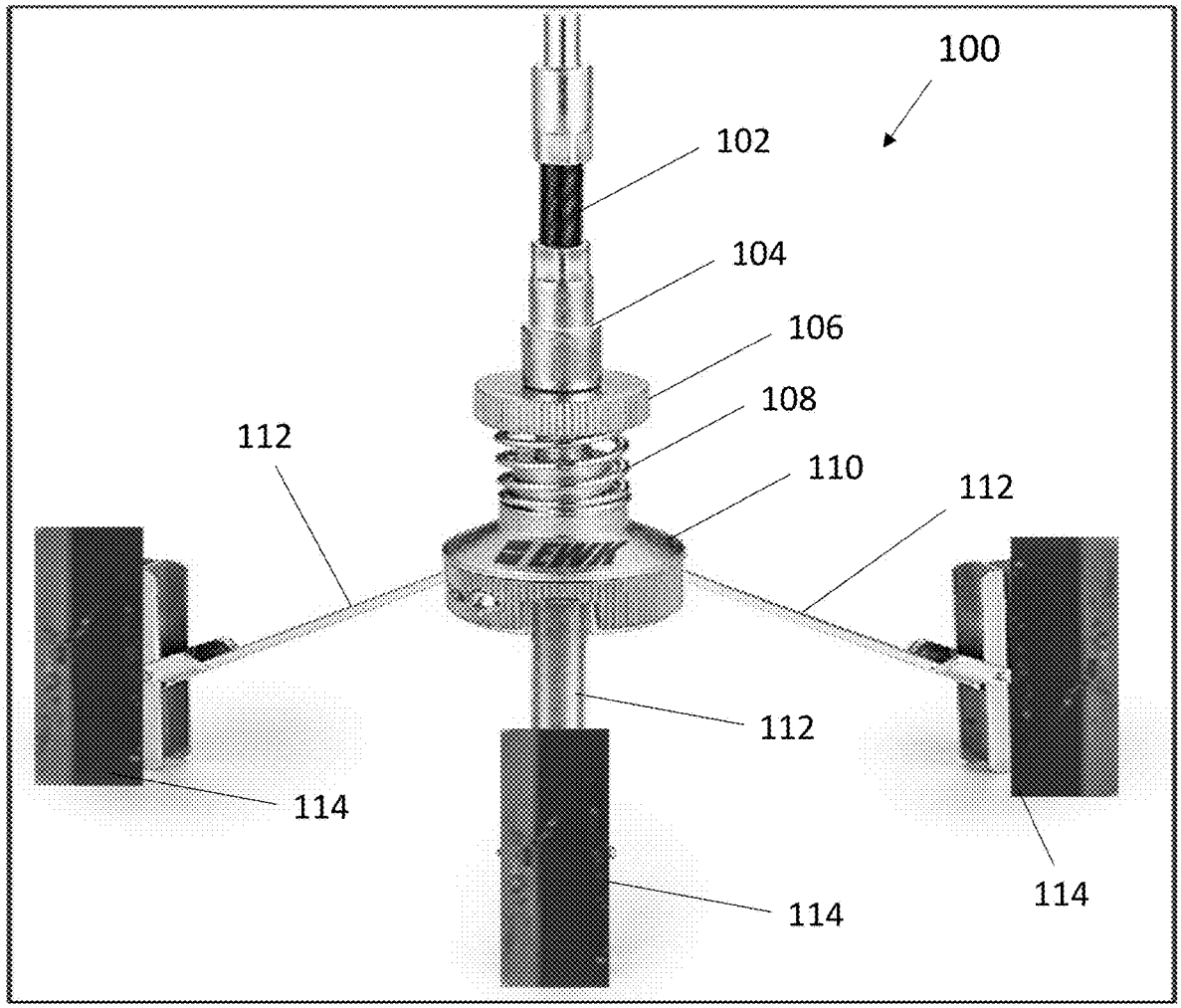
FIG. 1 is a depiction of a device for coating and/or plating a metal surface, such as, for instance, the interior of a gun barrel, according to at least one embodiment of the present disclosure.

The present invention is more fully described below with reference to the accompanying figures. The following description is exemplary in that several embodiments are described (e.g., by use of the terms "preferably," "for example," or "in one embodiment"); however, such should not be viewed as limiting or as setting forth the only embodiments of the present invention, as the invention encompasses other embodiments not specifically recited in this description, including alternatives, modifications, and equivalents within the spirit and scope of the invention. Further, the use of the terms "invention," "present invention," "embodiment," and similar terms throughout the description are used broadly and not intended to mean that the invention requires, or is limited to, any particular aspect being described or that such description is the only manner in which the invention may be made or used. Additionally, the invention may be described in the context of specific applications; however, the invention may be used in a variety of applications not specifically described.

The embodiment(s) described, and references in the specification to "one embodiment," "an embodiment," "an example embodiment," etc., indicate that the embodiment(s) described may include a particular feature, structure, or characteristic. Such phrases are not necessarily referring to the same embodiment. When a particular feature, structure, or characteristic is described in connection with an embodiment, persons skilled in the art may effect such feature, structure, or characteristic in connection with other embodiments whether or not explicitly described.

In the several figures, like reference numerals may be used for like elements having like functions even in different drawings. The embodiments described, and their detailed construction and elements, are merely provided to assist in a comprehensive understanding of the invention. Thus, it is apparent that the present invention can be carried out in a variety of ways, and does not require any of the specific features described herein. Also, well-known functions or constructions are not described in detail since they would obscure the invention with unnecessary detail. Any signal arrows in the drawings/figures should be considered only as exemplary, and not limiting, unless otherwise specifically noted. Further, the description is not to be taken in a limiting sense, but is made merely for the purpose of illustrating the general principles of the invention, since the scope of the invention is best defined by the appended claims.

It will be understood that, although the terms "first," "second," etc. may be used herein to describe various elements, these elements should not be limited by these terms. These terms are only used to distinguish one element from another. Purely as a non-limiting example, a first element could be termed a second element, and, similarly, a second element could be termed a first element, without departing from the scope of example embodiments. As used herein, the term "and/or" includes any and all combinations of one or more of the associated listed items. As used herein, "at least one of A, B, and C" indicates A or B or C or any combination thereof. As used herein, the singular forms "a," "an," and "the" are intended to include the plural forms as well, unless the context clearly indicates otherwise.

It should also be noted that, in some alternative implementations, the functions and/or acts noted may occur out of the order as represented in at least one of the several figures. Purely as a non-limiting example, two figures shown in succession may in fact be executed substantially concurrently or may sometimes be executed in the reverse order, depending upon the functionality and/or acts described or depicted.

As used herein, ranges are used herein in shorthand, so as to avoid having to list and describe each and every value within the range. Any appropriate value within the range can be selected, where appropriate, as the upper value, lower value, or the terminus of the range.

Unless indicated to the contrary, numerical parameters set forth herein are approximations that can vary depending upon the desired properties sought to be obtained. At the very least, and not as an attempt to limit the application of the doctrine of equivalents to the scope of any claims, each numerical parameter should be construed in light of the number of significant digits and ordinary rounding approaches.

"About" means a referenced numeric indication plus or minus 10% of that referenced numeric indication. For example, the term "about 4" would include a range of 3.6 to 4.4. All numbers expressing quantities of ingredients, reaction conditions, and so forth used in the specification are to be understood as being modified in all instances by the term "about." Accordingly, unless indicated to the contrary, the numerical parameters set forth herein are approximations that can vary depending upon the desired properties sought to be obtained. At the very least, and not as an attempt to limit the application of the doctrine of equivalents to the scope of any claims, each numerical parameter should be construed in light of the number of significant digits and ordinary rounding approaches.

The words "comprise," "comprises," and "comprising" are to be interpreted inclusively rather than exclusively. Likewise the terms "include," "including," and "or" should all be construed to be inclusive, unless such a construction is clearly prohibited from the context. The terms "comprising" or "including" are intended to include embodiments encompassed by the terms "consisting essentially of" and "consisting of." Similarly, the term "consisting essentially of" is intended to include embodiments encompassed by the term "consisting of." Although having distinct meanings, the terms "comprising," "having," "containing," and "consisting of" may be replaced with one another throughout the description of the invention.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

"Typically" or "optionally" means that the subsequently described event or circumstance may or may not occur, and that the description includes instances where said event or circumstance occurs and instances where it does not.

Wherever the phrase "for example," "such as," "including," and the like are used herein, the phrase "and without limitation" is understood to follow unless explicitly stated otherwise.

Embodiments of the present disclosure are directed towards devices, systems, and methods for coating and/or plating a surface, including, for instance, an interior and/or exterior surface of a metal tubular. The terms "tubular" and "tube," though having distinct meanings, are used interchangeably herein. Specifically, the term "tubular," at least as used herein, means (1) having the form of, or including, a tube and/or tube-shaped article, (2) shaped like a tube and/or tube-shaped article, (3) made or provided with a tube and/or tube-shaped article, and/or (4) characterized by a tube and/or tube-shaped article. A tube and/or tube-shaped article includes, for instance, structures that are long, round, cylindrical, and hollow in shape.

In some embodiments, a device comprising an applicator that is connected to, and rotatable around, a rod or cylindrical tube is used to apply a coating and/or plating on the surface. A low power circuit may be connected to both the surface to be coated and the applicator in order to supply an electrical current that powers the coating and/or plating. In further embodiments, the applicator may comprise one or more applicator pads that physically contact the surface to be coated. These one or more applicator pads may contain one or more coatings that are applied to the surface via the aforementioned physical contact. These applicator pads may, in some embodiments, traverse the surface to be coated and/or plated in order to apply the one or more coatings.

In some embodiments, the one or more coatings include a novel nanocomposite ablative coating that comprises an electroplated nanostructured porous metal layer combined with embedded nanoparticles. The metal layer may comprise, for example, zinc (Zn) and nickel (Ni), and/or alloys thereof. The embedded nanoparticles may comprise, for instance, titanium dioxide ($TiO_2$) and hexagonal Boron Nitride (hBN), which are anti-corrosion, friction-reducing, and/or thermally insulating. These embedded nanoparticles are loaded into the porous metal layer and fit within the gaps present in that layer.

Accordingly, embodiments of the disclosure reduce erosion and/or wear of metal surfaces, including, for instance, tubulars and gun barrels. With respect to the non-limiting example of gun barrels (e.g., military-grade medium or large guns, military small arms, civilian firearms such as rifles, and the like), a skilled artisan will recognize that wear and erosion are the two most significant problems that affect the overall functioning of a gun. Indeed, application of coating embodiments of the disclosure described herein extends the functional lifespan of the firearm and/or gun, even if the firearm and/or gun has already been plated with the current, state-of-the-art, chromium plating. One or more of these coating embodiments can deform over time and simultaneously act as a thermal barrier to reduce and slow the rapid heating. Thus, adding such coatings to a gun barrel, even a barrel that has already been plated with the state-of-the-art chromium plating, can slow the rapid heating that the chrome/steel interface is subjected to during each firing. Such ablative coatings can also be used to reduce the friction between the projectile and the gun bore.

More specifically, gun barrel erosion can lead to reduced performance, availability, and functionality, resulting in additional expense to replace one or more portions of the gun. Further, erosion of a gun barrel under normal firing conditions can result in damage to the bore, causing bore diameter to progressively increase with usage. This erosion has a typical rate of between 0.1-200 μm per firing, with the maximum erosion occurring in the origin of rifling (OR). Erosion of a gun barrel can lead to different kinds of failure, including, but not limited to, inter-granular stress corrosion cracking (SCC), fatigue, hydrogen embrittlement, and the like.

Additionally, when a gun is fired, the barrel wall (which is a non-limiting example of a metal tubular) is subjected to a high-temperature and/or high-pressure environment due to the presence of hot gases (e.g., typically at a temperature of around 3000 K and at a pressure of 400 MPa, for up to 20 ms). Such heating leads to softening of the tubular surface, thermal phase transformation, and melting of the bore surface. Considerable thermal heating, due to forced convection, can be caused by gas wash between the projectile driving band and the bore surface. The main constituents of propellant gases are CO, $CO_2$, $H_2$, $H_2O$ and $N_2$. Minor components include, but are not limited to, $NH_3$, $CH_4$, NO, free radicals, and ions. Gun propellants are formulated to be oxygen deficient so that their combustion products are reducing in nature. However, carbon and nitrogen can diffuse into the barrel, softening the bore surface. Mechanical contributions to wear can also arise from the propellant gases and the fired projectile. Unburnt propellant and small solid particles from the primer and other sources are entrained in the high velocity gas flow and have an abrasive effect on the bore surface. For instance, for a rifled barrel, mechanical wear arises from the engraving of the driving band into the lands and grooves at the commencement of rifling. This process causes considerable stress on the gun barrel. The spinning of the projectile as it travels along the barrel causes further mechanical wear. For rifled and smooth bore barrels, the radial pressure between the driving band and the bore produces friction and an abrasive action on the bore surface.

As a result, gun barrel erosion can be caused by a combination of chemical, thermal, and/or mechanical processes acting together, resulting in a weakening of one or more surfaces of the gun (e.g., the barrel surface). Chemical processes include, for instance, carburizing or oxidizing reactions that can result in ablation and deterioration of metal surfaces. Diffusion of gas from the propellant can also enter surfaces (e.g., the bore surface) and react with one or more components of those surfaces (e.g., steel). Thermal erosion can be in the form of the phase change and the melting and cracking of surfaces (e.g., the bore surface), which are caused by expansion and contraction arising from the thermal cycling inside the gun barrel. Mechanical erosion arises from the direct impingement of gases and particulate on surfaces (e.g., the bore surface). Other contributors to mechanical erosion include, for example, shearing action of the gas flow, removal of material by driving bands, and crack propagation due to ballistic pressure cycles.

Turning now to FIG. 1, a device 100 is illustrated for coating and/or plating a metal surface, such as, for instance, the interior of a gun barrel. Such coating and/or plating results in reduction of wear on the surface due to the aforementioned chemical, thermal, and/or mechanical processes. The coating may be, for instance, any coating described with reference to the Solid Electrolyte/Electrode Assembly For Electrochemical Surface Finishing Applications (SOAP) technology in the above-mentioned patents incorporated by reference. It should be appreciated that at least one such SOAP coating is gelatinous and/or compressible such that it can adapt to different diameters of tubulars (e.g., smaller diameters due to corrosion).

The device 100 comprises a rod 102 and an applicator 104 that is rotatable around the rod 102. The rod may be any shape that corresponds to the geometry of the surface that is to be coated and/or plated. As a non-limiting example, the rod may be cylindrical in order to fit inside metal tubulars (e.g., gun barrels). The applicator further comprises a screw 106 and a spring 108. The screw and the spring allow the one or more arms 112, described in further detail below, to adjust to fit the diameter of the tubular to be coated and/or plated. As an example, when the screw is tightened, the arms 112 extend straighter and therefore accommodate a larger-diameter tubular. Similarly, when the screw is loosened, the arms 112 extend to accommodate a narrower-diameter tubular.

The applicator 104 further comprises a base 110 on which are fixedly attached one or more arms 112. The end of each of the arms is connected to the base, and the arms themselves extend away from the rod and the applicator. Another end of the arms is attached to one or more applicator pads 114. These applicator pads 114 contain the coating and/or plating to be attached to the surface to be coated and/or plated. Non-limiting examples of such coating will be discussed in further detail below.

In the non-limiting example shown in FIG. 1, one applicator pad is attached to each of three arms 112. However, a skilled artisan will recognize any number of arms and/or applicator pads may be used. Thus, the device 100 can be used to coat and/or plate, for example, medium to large guns, military small arms, and civilian firearms (e.g., rifles) by rotating inside the gun bore (and/or rotating the gun bore around the device 100). The arms 112 force the applicator pads 114 which contain the coating against the bore surface.

In at least one embodiment, the one or more arms 112 are retractable and extendable via any mechanism(s) known in the art (e.g., springs). The arms can be extendable into the position shown in FIG. 1, and can be retracted so that device 100 can be easily removed after applying the coating and/or plating. In such a fashion, the arms can be adjusted to accommodate multiple sizes and/or diameters of tubulars.

Figure 2A:
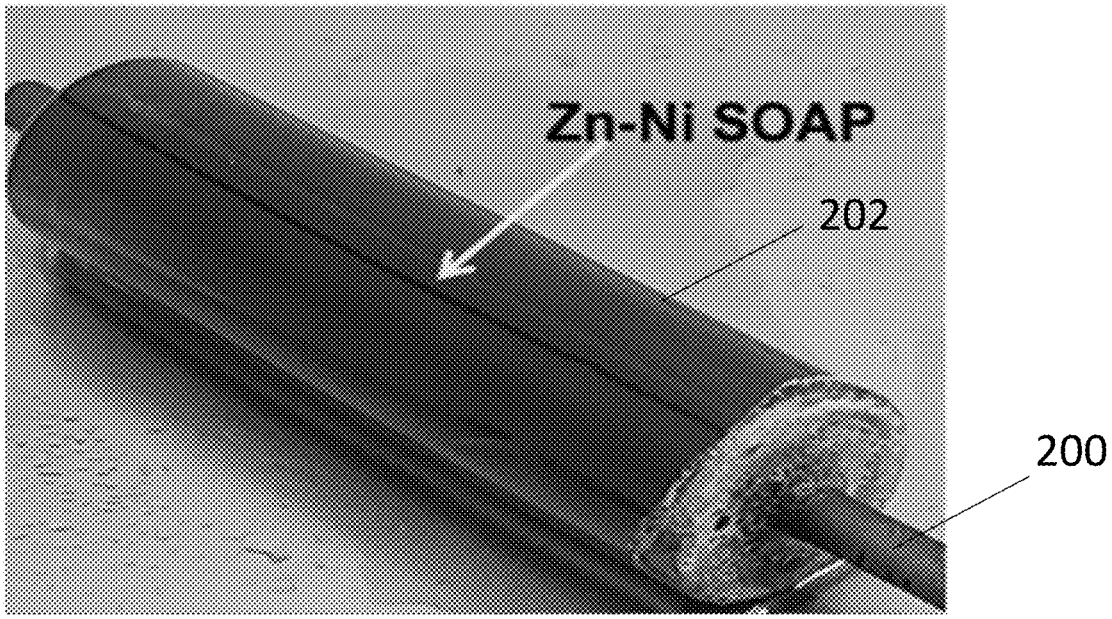
FIG. 2A depicts an applicator rod with a solid electrolyte, according to at least one embodiment of the present disclosure.
Figure 2B:
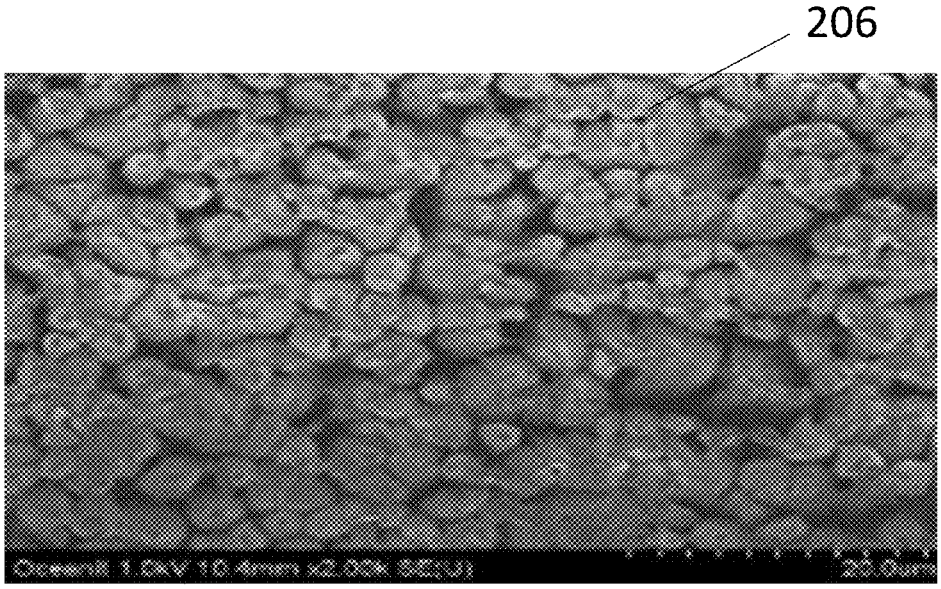
FIG. 2B depicts a microscopic view of the disclosed metal alloy plating, according to at least one embodiment of the present disclosure.
Figure 2C:
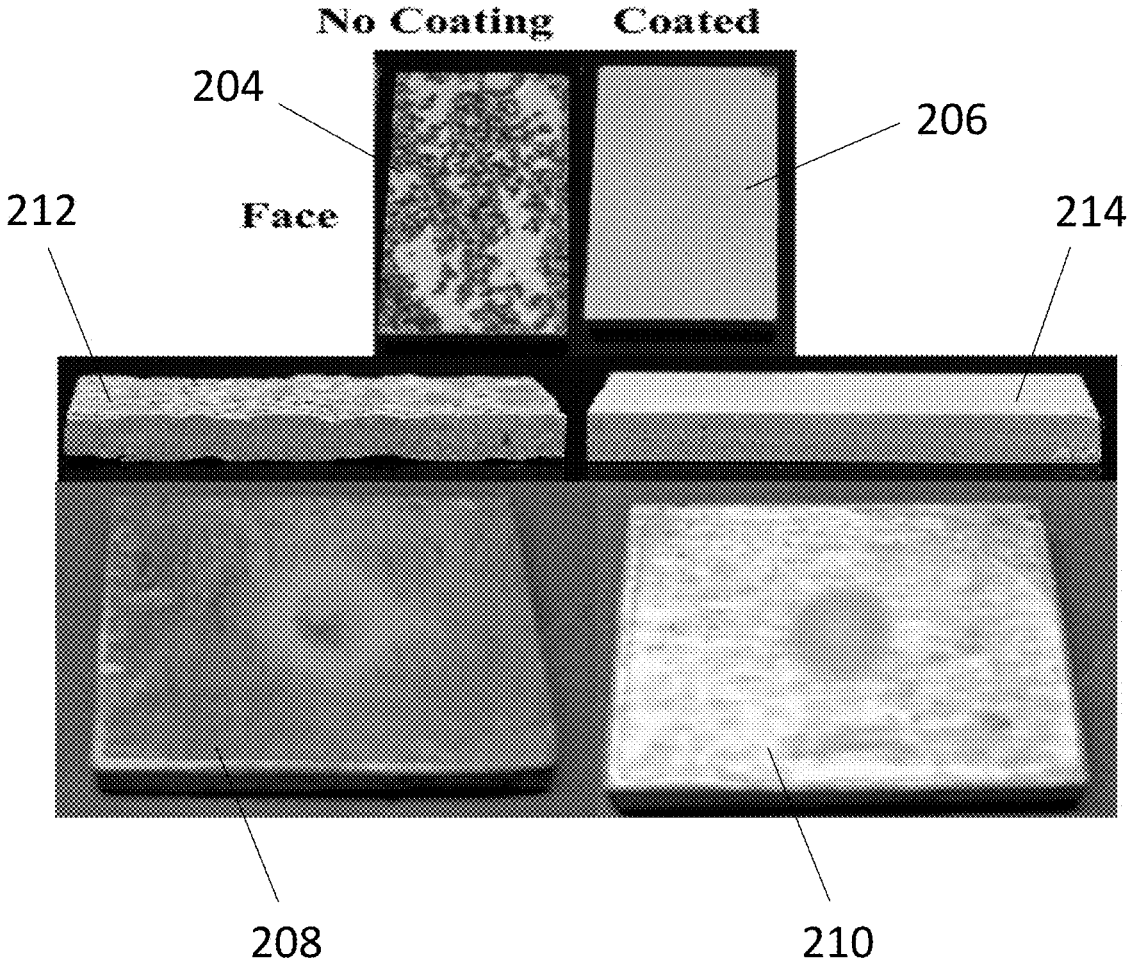
FIG. 2C depicts examples of the visual differences between coated/plated surfaces and non-coated/non-plated surfaces, according to at least one embodiment of the present disclosure.

An applicator rod 200 with Zinc-Nickel solid electrolyte 202 is shown in FIG. 2A. The Zinc-Nickel solid electrolyte 202 may be prepared using the methods described in the SOAP Patents. The applicator rod 202 can be inserted into a tubular so that the electrolyte 202 contacts the interior surface of the metal tubular. When the tubular is rotated with respect to the electrolyte 202, and electrical energy is applied, the material of the solid electrolyte 202 is deposited onto the interior surface of the tubular. A microscopic view of the deposited Zinc-Nickel alloy coating 206 is shown in FIG. 2B. Examples of the visual differences between coated and non-coated surfaces are shown in FIG. 2C. The face of a non-coated surface is shown at 204, while the face of a coated version of the same surface is shown at 206. Similarly, the face of another non-coated surface is shown at 208, while the face of a coated version of the same surface is shown at 210. An edge view of a non-coated surface is shown at 212, while the edge of a coated version of the same surface is shown at 214.

As can be seen from FIG. 2B, the surface coating 202 may be porous on a microscopic and/or nanoscopic level. Thus, in some embodiments, the surface coating is a novel nanocomposite ablative coating that comprises an electroplated nanostructured porous metal layer combined with embedded nanoparticles. The porous metal layer may comprise, for example, zinc (Zn) and nickel (Ni), and/or alloys thereof. The embedded nanoparticles may comprise, for instance, titanium dioxide ($TiO_2$) and hexagonal Boron Nitride (hBN) particles, which are known to be anti-corrosion, friction-reducing, and/or thermally insulating. These embedded nanoparticles can be loaded into the porous metal layer and fit within the gaps present in that layer, by application to the porous metal layer in a solvent. When the solvent evaporates, the nanoparticles remain embedded in the pores of the metal alloy layer. In at least one instance, only one type of nanoparticle is loaded (e.g., either $TiO_2$ or hBN, but not both). For example, $TiO_2$ may be used in at least some applications to increase surface roughness of a tubular surface.

Both $TiO_2$ and hBN particles have shown significant effects when used as additives to fuels, greatly reducing frictional wear during combustion. These particles can act as tiny ball bearings to reduce friction, and to shield the coated metal surface from chemical erosion and/or corrosion (since they are exposed as the coating is slowly worn away during use). Since such particles have no inherent bonding capability to metal (e.g., steel or chromium) plating, they are instead retained on the coated surface through physical entrapment (e.g., in the porous Zn—Ni metal layer described above herein).

The nanoporous Zn—Ni layer shows significantly improved resistance against hydrogen embrittlement when compared to current, state-of-the-art electroplating techniques. The normally liquid plating electrolyte is suspended in a novel polymer binder layer (e.g., as described with reference to the SOAP technology, where the polymer binder is a carrier and does not form part of the deposited metal layer), enabling the concentration of metal ions to be maintained at far higher local concentrations than using liquid electrolyte plating alone. Plating in such a manner (e.g., using SOAP technology) provides several advantages over traditional plating, including, for instance, allowing for the plating of areas that cannot traditionally be filled with liquid. This permits the plating of more surfaces as well as the delivery of one or more coatings on top of the plated surface. The novel polymer binder layer (e.g., as described with reference to the SOAP technology), which is a blend of polymer binders, does not change the chemical composition of the coating/plating. However, the metal ions deposited can be subtly changed based on applied voltage and application technique. For instance, increasing the current and/or duration leads to a thicker deposited layer. As an additional benefit, the ability to form the solid electrolyte into a variety of shapes and the ability to plate using an automated process (such as the device shown in FIG. 1) allows for simple field application that is bath-less and can be done as part of periodic maintenance. Due to the solid electrolyte, no hazardous liquid waste is formed and fume generation is minimized.

Significantly, it was discovered that the need for baking to remove hydrogen can be eliminated through application of the metal using SOAP technology, which results in a complex, three-dimensional geometry of the coating/plating. The resulting nanoporous metal layer has enhanced resistance towards hydrogen embrittlement and cracking, as it can allow hydrogen and other entrapped gases to freely escape, while the nanoscale voids/gaps allow for the underlying metal surface to expand and contract without developing entrained stress cracking.

In at least one embodiment, the ablative coating described above herein encapsulates the metal plating electrolyte in a single solid conductive block that can eliminate the need for a liquid plating bath. The resulting plated layer is highly corrosion resistant without the need for baking, since the porous structure allows for free escape of entrapped hydrogen and easy relaxing of stress cracking. In at least an additional embodiment, further treatment with a nanoparticle lubricant fills the pores within the porous metal alloy. The aforementioned nanoparticles are described above herein, e.g., $TiO_2$ and hBN particles. The nanoparticles generally will not adhere to the tubular surface (e.g., metal surface of a gun) but can be embedded into the pores of the plated metal layer.

Figure 3:
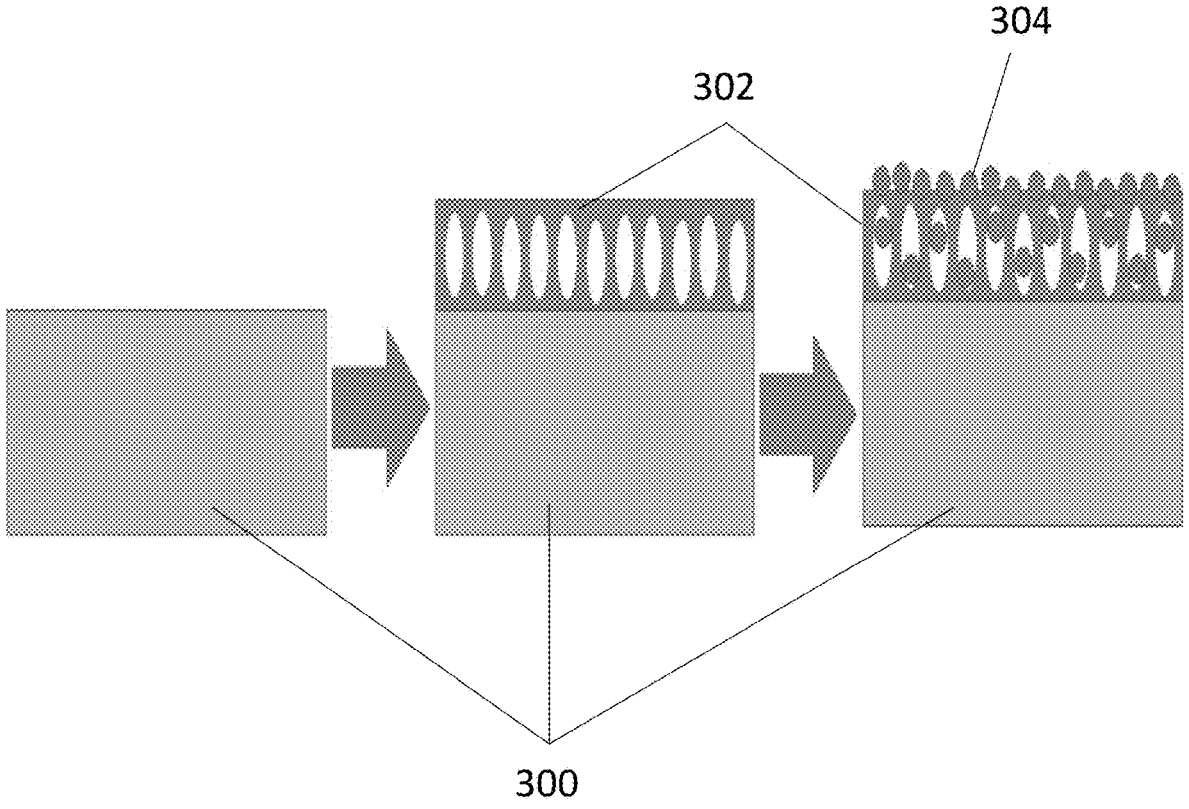
FIG. 3 depicts a metal surface that has been coated/plated with an ablative, porous metal alloy coating, and further treated with a coating comprising lubricating nanoparticles that fill in the pores within the porous metal alloy coating, according to at least one embodiment of the present disclosure.

This is shown in further detail in FIG. 3. First, a metal surface 300 is provided. This surface is then coated/plated with the ablative metal coating 302, which, as mentioned above herein, has a porous structure. Further treatment with a nanoparticle lubricant results in nanoparticles 304 filling the pores within the metal coating 302.

With respect to the non-limiting example of a coated gun bore, as the coating cracks and deforms during firing, the particles trapped within the pores become exposed to the surface, acting as both a thermal barrier and a lubricant. Although the nanoparticles on the very top of the surface may not survive long in operational conditions of a gun bore, operation erodes the top of the porous metal layer, revealing further lubricating nanoparticles embedded within the pores of the metal layer. The coating can remain effective as long as embedded particles remain.

The table below shows non-limiting examples of compositions of the solid electrolyte used to deposit a porous metal layer, and specifically, a Zn—Ni metal alloy layer.

TABLE 1

Exemplary compositions of Zn-Ni electrolyte.

| Compositions | Concentration (grams/L (g/L)) |
|---|---|
| Zinc oxide | 5-20 g/L |
| Nickel sulfate | 5-40 g/L |
| Sodium hydroxide (NaOH) | 100-150 g/L |
| Complexing Agent (e.g., Triethanol amine) | 55-128 g/L |

The $TiO_2$/hBN particles applied to the plated metal alloy layer can have a particle diameter that ranges between 100 nm to 1 μm at 2-4% wt loading or higher (e.g., approaching or equaling the weight and/or thickness of the metal layer, such as 5-10 microns per layer). The loading percentage is with reference to one or more suspension and/or delivery solutions (which are not plated) and can be, for instance, between 1-20% wt. Such solutions can comprise, for example, one or more suitable solvents (e.g., a solvent that may be flash dried). Non-exemplary suspension solutions that provide wettability include, for instance, water with methyl cellulose surfactant, 90%+ ethanol, short chain fluorocarbons with PFPE surfactant (e.g., Vertrel XF with a PFPE alcohol termination group (Fluorolink E-10H, Solvay)).

Since the ablative coating has a porous metal layer, which can wear down and compress in predictable ways, the usual failure method of stress corrosion cracking concentrating in singular grain defects can be greatly lessened and/or eliminated. In some embodiments, a secondary highly lubricious topcoat sealant (which may, in at least one embodiment, be applied by one or more applicator devices described herein using, for instance, different pads) can be added after application of the initial coating in order to address potential reduced hardness and wear resistance, and to guard against flash rust formation and pinhole formation. This topcoat sealant may comprise, for instance, hard ceramic nanoparticles suspended within a quick drying solvent (e.g., hBN, $TiO_2$, $Al_2O_3$, $CeO_2$, etc. nanoparticles in any volatile solvent including, for instance, acetone, isopropanol, one or more hexanes, etc.). Taking advantage of the porous nature of the metal layer of the initial coating, the lubricating hard ceramic nanoparticles can be readily absorbed and retained. These hard ceramic nanoparticles may include, for instance, either $TiO_2$ or hBN. Thus, $TiO_2$ or hBN nanoparticles can be applied after the initial coating with the metal layer, as described above herein. The extreme wettability of the initial nanoporous coating thus allows for far higher loading and retention of the lubricant, greatly lowering the frictional forces acting on the coating. Additionally, as the coating wears down over time, more of the lubricating nanoparticles are exposed and released, allowing the aforementioned benefits to be retained over a longer period of time.

Thus, a coated surface is highly resistant to particle erosion and exfoliation corrosion. Such a coated surface, if located inside a gun or firearm, is capable of mitigating gun bore erosion due to high pressures and/or high temperatures generated through the ignition of a propellant gas during firing. This results in an extension of the functional lifetime of the gun barrel from projectile and gas erosion during operation.

The aforementioned ablative coating, when coated via a device such as any of the devices described herein, allows for application of coatings in highly confined, minimally accessible spaces, such as, for instance, the interior tubes of heat exchangers (roughly 0.5 inches in diameter), and large-scale transport pipelines (roughly 36-48 inches in diameter).

Figure 4A:
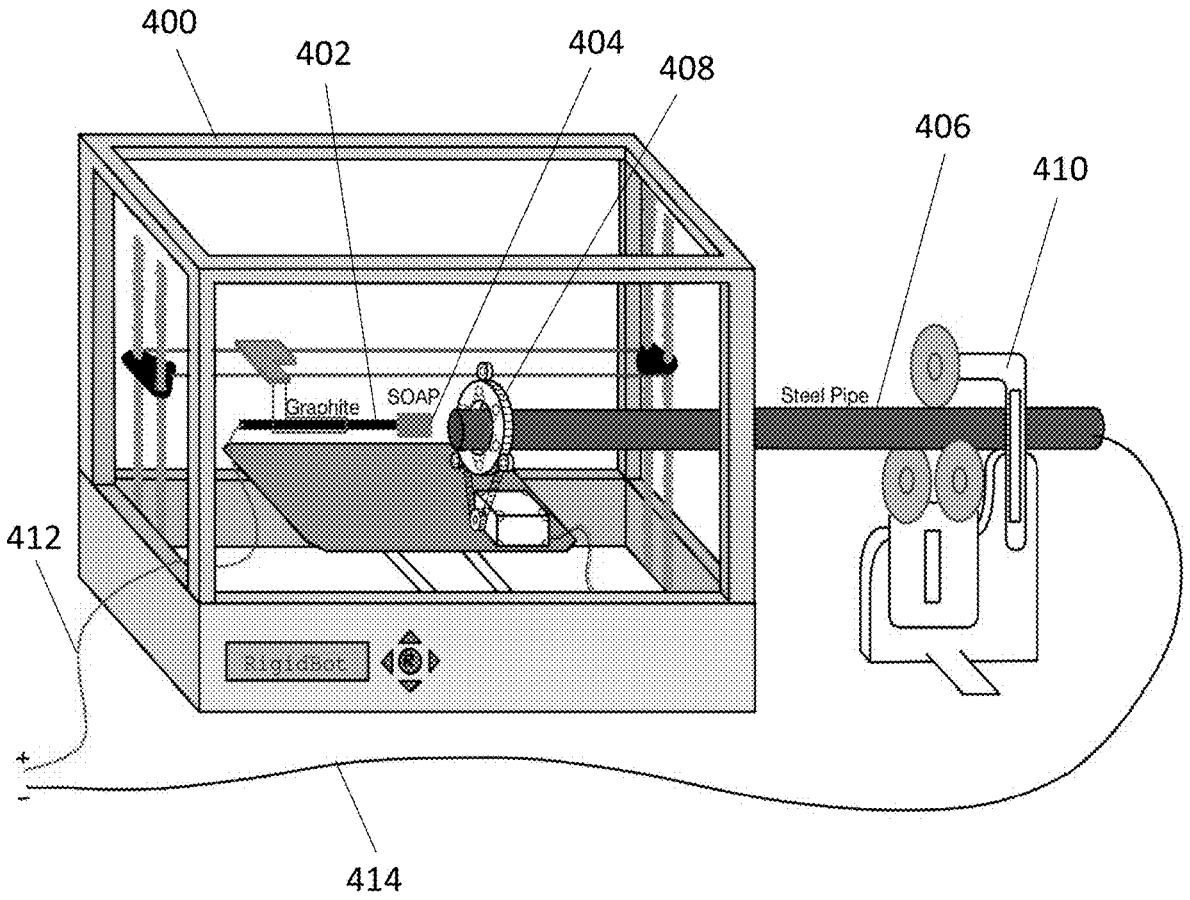
FIGS. 4A-4B depict a device for coating and/or plating a metal surface, such as, for instance, the interior of a pipe (FIG. 4A) and usage of the device for plating a pipe using SOAP technology (FIG. 4B), each according to at least one embodiment of the present disclosure.

Turning now to FIG. 4A, a device 400 is illustrated for coating and/or plating a metal surface, such as, for instance, the interior of a pipe or tubular. In at least one embodiment, device 400 is used in a similar manner to device 100 and can be used with respect to smaller diameter pipes or bores. The device 400 comprises a rod 402 (which may comprise, e.g., graphite) and an applicator 404. The rod may be any shape that corresponds to the geometry of the surface that is to be coated and/or plated. As a non-limiting example, the rod may be cylindrical in order to fit inside metal tubulars (e.g., steel pipe 406). The applicator 404 applies the metal alloy plating and/or lubricating nanoparticle coating. Applicator 404 may be, for example, a brush electrode covered by solid/semi-solid SOAP coating material as disclosed in the SOAP Patents. The pipe 406 to be coated and/or plated can be held in place with respect to the rod 402 and the applicator 404 by, for instance, portions 408 and 410. Positive (+) and negative (−) leads 412 and 414 extend from one end of the applicator 402 and one end of the pipe 406, respectively.

In the embodiment shown, the rod 402 and applicator 404 are moved linearly forwards into steel pipe 406, while steel pipe 406 is rotated around the applicator 404 which contacts the interior of the pipe 406. In various embodiments, the rod 402 and applicator 404, and/or the steel pipe or other tubular/object to be coated 406 are held still, moved laterally, and/or rotated. The applicator 404 contacts the interior of the pipe 406 or other object while the applicator 404 and pipe 406 rotate with respect to each other, and applicator 404 contacts the entire interior surface (or the extent intended to be treated with the applied coating) of the pipe 406. In other words, at least one of the rod 402 and applicator 404 and the pipe 406 moves linearly so that the applicator 404 moves through the entirety of the pipe 406 (assuming the pipe 406 is longer than the applicator 404), and at least one of the rod 402 and applicator 404 and the pipe 406 rotates to create differential rotation between the applicator 404 and pipe 406 to encourage plating of the electrolyte from the applicator 404 onto the interior surface of pipe 406. The same rod 402 and applicator 404 assembly can be used to apply non-SOAP material, for example the SOAP applicator 404 can be removed from the rod 402 and replaced with another applicator (not shown) that is coated with a lubricating nanoparticle solution.

In at least one example, the applicator 404 does not have a mechanically adjustable diameter. However, the solid electrolyte SOAP material on the applicator 404 may be gelatinous and/or compressible such that it can adapt to different diameters of tubulars (e.g., smaller diameters due to corrosion).

Figure 4B:
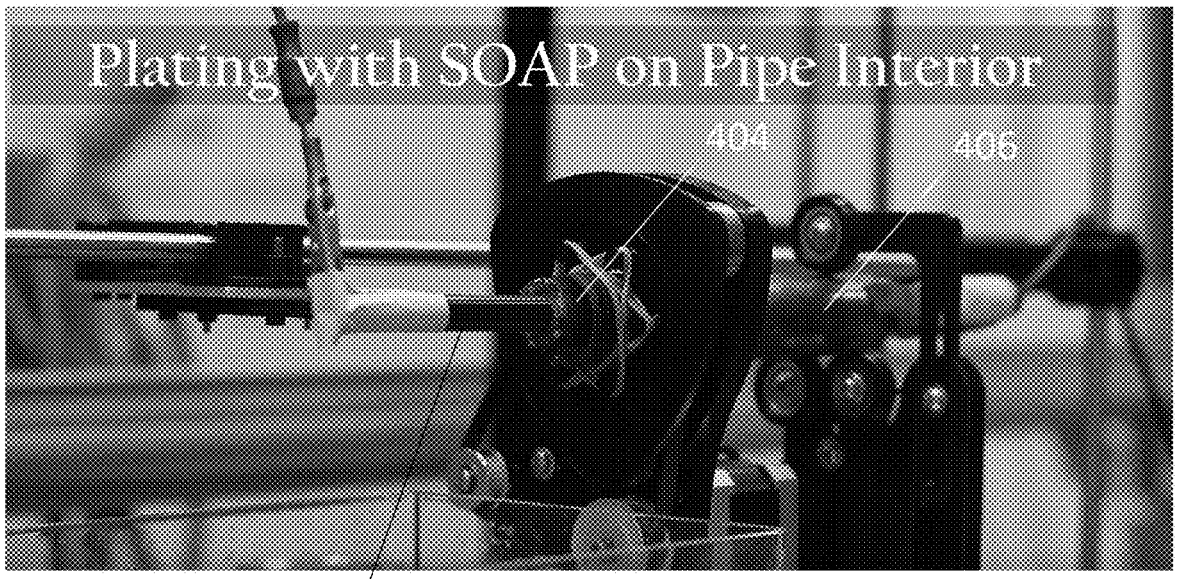

FIG. 4B is a diagram 450 showing the device 400 plating the interior of a pipe. Specifically, the device 400 is used to plate the pipe interior using SOAP technology.

Embodiments of the disclosure therefore reduce life cycle cost by extending the service life of various metal surfaces, including gun weapon systems. Such cost reduction can provide substantial value for, among others, defense companies, commercial firearms manufacturing and service companies, energy companies seeking solutions to resist corrosive and erosive environmental effects on pipes and tubulars, and the like.

These and other objectives and features of the invention are apparent in the disclosure, which includes the above and ongoing written specification.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated.

The invention is not limited to the particular embodiments illustrated in the drawings and described above in detail. Those skilled in the art will recognize that other arrangements could be devised. The invention encompasses every possible combination of the various features of each embodiment disclosed. One or more of the elements described herein with respect to various embodiments can be implemented in a more separated or integrated manner than explicitly described, or even removed or rendered as inoperable in certain cases, as is useful in accordance with a particular application. While the invention has been described with reference to specific illustrative embodiments, modifications and variations of the invention may be constructed without departing from the spirit and scope of the invention as set forth in the following claims.

What is claimed is:

1. A device for applying a coating to a surface, the device comprising:
- a rod;
- an applicator rotatable around the rod, the applicator comprising:
  - a base,
  - one or more arms extending away from the base, each of the one or more arms having a first end and a second end, and
  - one or more applicator pads comprising a coating to be applied to a surface;
- a spring extending vertically upwards from a top surface of the base; and
- a screw connected to the spring,
- wherein the first end of the one or more arms is attached to the base, and
- wherein the second end of the one or more arms is attached to the one or more applicator pads.

2. The device of claim 1, wherein the one or more arms are retractable towards, and extendable away from, the base.

3. The device of claim 1, wherein the surface is a surface of a tubular, and wherein the rod is circular to match a shape of the tubular.

4. The device of claim 1, wherein the one or more applicator pads are configured to force the one or more applicator pads against the surface, thereby applying the coating to the surface.

5. The device of claim 1, wherein the coating comprises a porous metal oxide layer and a plurality of nanoparticles embedded within the porous metal oxide layer.

6. The device of claim 5, wherein the porous metal oxide layer comprises zinc and nickel.

7. The device of claim 6, wherein the zinc and the nickel are suspended in a blend of polymer binders prior to application to the surface.

8. The device of claim 5, wherein the plurality of nanoparticles comprises titanium dioxide and/or hexagonal boron nitride.

9. The device of claim 1, wherein the surface is at least one of an interior and an exterior of a gun barrel.

10. A method for coating a surface, the method comprising:
- applying a solid electrolyte to an applicator rotatable around a rod, the electrolyte comprising one or more metals suspended in a plurality of polymer binders;
- contacting the applicator to a surface, thereby depositing the one or more metals in a layer on the surface; and
- treating the deposited metal layer with a solution comprising lubricious nanoparticles, such that the nanoparticles fill one or more pores in the deposited metal layer, thereby coating the surface,
- wherein the applicator comprises:
  - a base,
  - one or more arms extending away from the base, each of the one or more arms having a first end and a second end, and
  - one or more applicator pads comprising a coating to be applied to the surface, wherein a spring extends vertically upwards from a top surface of the base, wherein a screw is connected to the spring, wherein the first end of the one or more arms is attached to the base, and wherein the second end of the one or more arms is attached to the one or more applicator pads.

11. The method of claim 10, wherein the one or more metals comprises zinc and nickel.

12. The method of claim 10, wherein the electrolyte is applied to the surface without using a bath.

13. The method of claim 10, wherein the solution comprising lubricious naonparticles comprises a plurality of ceramic nanoparticles suspended within a solvent.

14. The method of claim 10, wherein the metals of the electrolyte comprise zinc oxide and nickel sulfate.

15. The method of claim 11, wherein the zinc comprises a zinc oxide having a concentration of 5-20 grams per liter (g/L) in the electrolyte, and wherein the nickel comprises a nickel sulfate having a concentration of 5-40 g/L in the electrolyte.

16. The method of claim 15, wherein the electrolyte further comprises:

sodium hydroxide in a concentration of 100-150 g/L; and a complexing agent in a concentration of 55-128 g/L.

17. The method of claim 16, wherein the complexing agent is triethanol amine.

18. The method of claim 10, wherein the applicator is an electrode, further comprising passing current through the electrode and surface to deposit the one or more metals to the surface.

* * * * *